US005316552A

United States Patent [19]

Jasper et al.

[11] Patent Number: 5,316,552

[45] Date of Patent: May 31, 1994

[54] LINE MARKING APPARATUS

[76] Inventors: Warren J. Jasper, 127 Donna Pl., Cary, N.C. 27513; David C. Falk, 6808 Greystone Dr., Raleigh, N.C. 27615

[21] Appl. No.: 989,699

[22] Filed: Dec. 14, 1992

[51] Int. Cl.[5] ..... D06P 7/00; B08B 3/12; D06F 3/00

[52] U.S. Cl. ..... 8/471; 8/149.2; 8/155.1; 8/483; 8/487; 68/198; 68/8

[58] Field of Search ..... 8/149.2, 155.1, 471, 8/483, 487; 68/198, 8

[56] References Cited

U.S. PATENT DOCUMENTS

| | | | |
|---|---|---|---|
| 570,115 | 10/1896 | Bloede | 8/471 |
| 1,796,039 | 3/1931 | Mijer | 8/149.2 |
| 1,895,243 | 3/1929 | Dort | 8/471 |
| 3,145,398 | 12/1961 | Wyatt | 8/155.2 |
| 3,413,080 | 11/1968 | Schlagenhof et al. | 8/155.2 |
| 4,718,917 | 1/1988 | Harbison | 8/149 |

*Primary Examiner*—Paul Lieberman
*Assistant Examiner*—Margaret Einsmann
*Attorney, Agent, or Firm*—Rhodes, Coats & Bennett

[57] ABSTRACT

A method and apparatus for applying dye marks to a line at predetermined fixed increments. An unmarked line is wound around a roller tube which has a slot formed therein communicating with the interior of the roller tube. A vaporized dye is supplied to the interior of the roller tube and exists through the slot and the roller tube. The disperse dye contacts and penetrates the portion of the line overlying the slot to produce a dye mark on the line at predetermined increments equal to the circumference of the roller tube.

22 Claims, 2 Drawing Sheets

LINE MARKING APPARATUS

BACKGROUND OF THE INVENTION

The present invention relates generally to a process for applying marks at predetermined increments to a continuously moving line.

In certain applications, it is desirable to measure the length of a line by optically detecting the presence of marks applied to the line at predetermined increments. For example, U.S. patent application Ser. No. 956,065, filed on Oct. 22, 1992 discloses an optical fishing line meter for measuring the length of a fishing line. A optical sensor detects dye marks on the fishing line as the fishing line passes by the optical sensor and either increments or decrements a counter.

Processes for applying dye or other coloring to a man-made line or filament are well known to those skilled in the art. The most common method used is to force a disperse dye through a package containing the line to color the line. This process is used primarily for coloring the line along its entire length. However, there is no known method for applying dye to a line at predetermined increments.

SUMMARY AND OBJECTS OF THE INVENTION

The present invention provides a method and apparatus for applying dye marks to a line at predetermined fixed increments. According to the present invention, an unmarked line is wound around a roller tube which has a slot formed therein communicating with the interior of the roller tube. A disperse dye is heated and vaporized. The vaporized dye is supplied to the interior of the roller tube and exits through the slot in the roller tube. The dye penetrates the portion of the line overlying the slot to produce a dye mark on the line at a predetermined increment equal to the circumference of the roller tube.

The present invention can be used in a continuously running process to mark an advancing line. In a continuously running process, the roller tube rotates such that the tangential speed of the roller tube exactly matches the speed of the advancing line. The advancing line winds onto the roller tube at one end and winds off of the roller tube at the opposite end. The process may be implemented either as a stand alone process, or may be combined with other treatment processes.

Accordingly, it is an object of the present invention to provide a line marking system and method for marking a line at predetermined fixed increments.

Another object of the present invention is to provide a line marking system for applying marks to a line where the line is continuously advancing.

Another object of the present invention is to provide a line marking system and method which is relatively simple in construction and has only a small number of moving components.

Yet another object of the present invention is to provide a line marking system and method for marking a line at predetermined increments which is capable at operating at relatively high speeds without diminishing the accuracy of the markings.

Other objects and advantages of the present invention will become apparent and obvious from a study of the following description and the accompanying drawings which are merely illustrative of such invention.

DETAILED DESCRIPTION OF THE INVENTION

Figure 1:
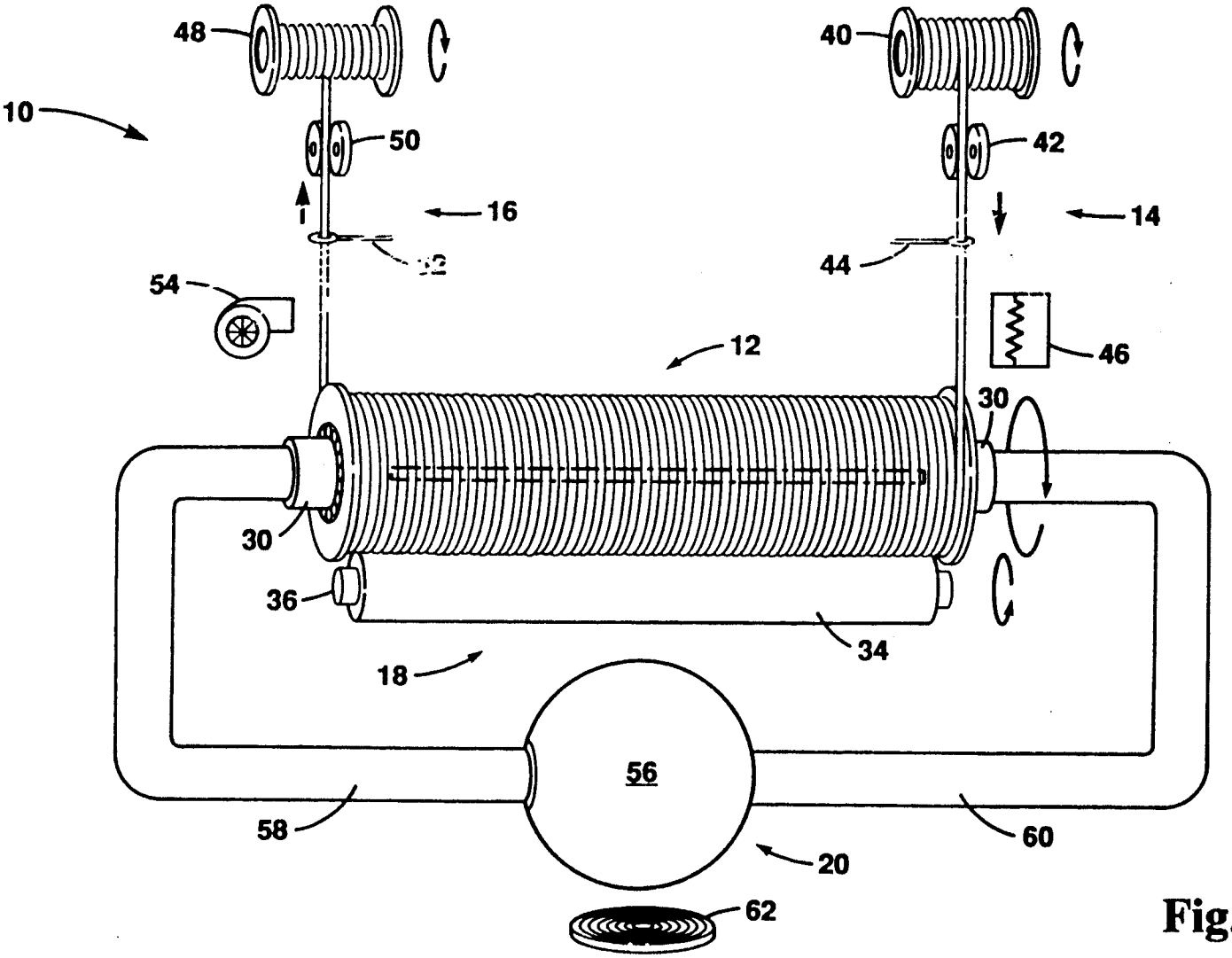
FIG. 1 is a schematic diagram illustrating the line marking system of the present invention.

Referring now to the drawings, the line marking system of the present invention is shown therein and indicated generally by the numeral 10. The line marking system 10 includes a marking roller 12 around which the line is wound, a line feed system 14 for feeding the unmarked line towards the marking roller 12, a line take-up means 16 for taking-up the marked line, drive means 18 for driving the marking roller 12, and a supply means 20 for supplying a disperse dye to the marking roller 12.

The line marking system 10 of the present invention is used to apply marks to a line at predetermined increments. In particular, the present invention is designed for use with man-made thermoplastic yarns such as nylon, acrylic, polyester and acetate yarns. The unmarked line is first wound onto the marking roller 12. A disperse dye is vaporized and supplied to the interior of the marking roller 12. The heated and vaporized dye passes through one or more openings in the marking roller 12 and impregnates the line. The location of the openings and the circumference of the roller 12 determine the increments between the marks.

Figure 2:
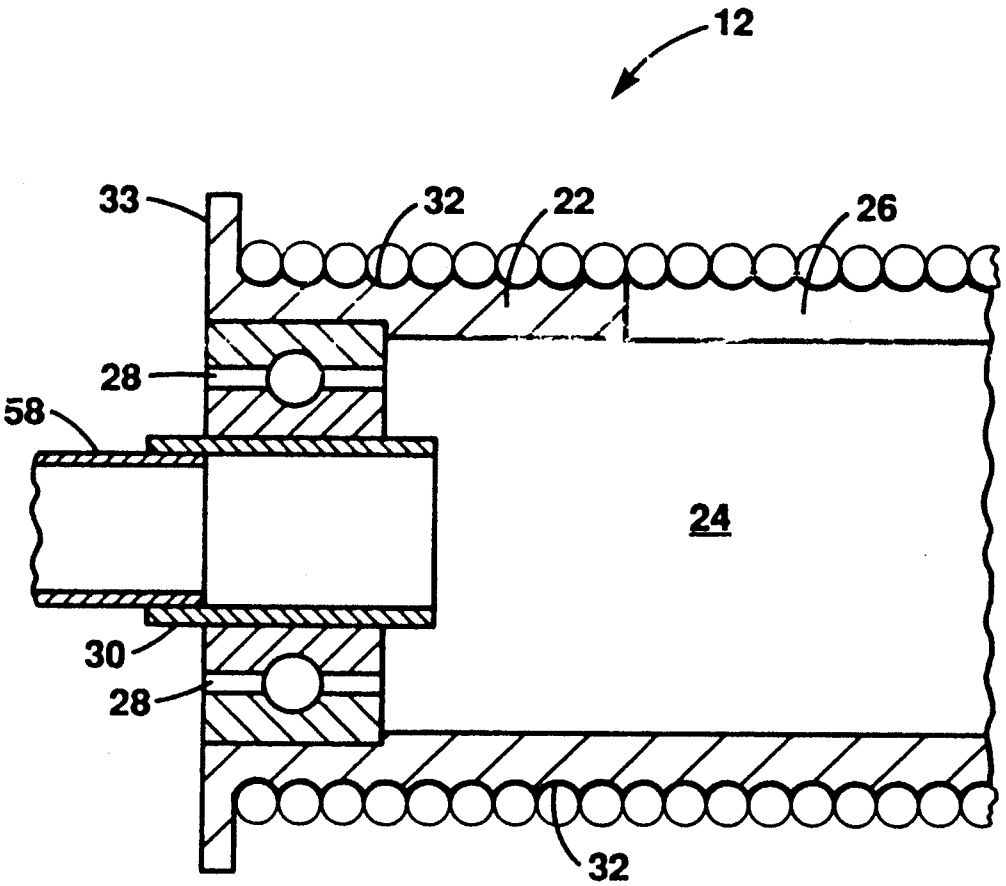
FIG. 2 is a partial section view illustrating the construction of the marking roller used in connection with the present invention.

Referring now to FIG. 2, the marking roller 12 is shown in more detail. The marking roller 12 comprises a generally cylindrical roller tube 22 made from thin-walled metal tubing. The interior of the roller 12 defines a dye chamber 24 which contains the vaporized disperse dye. A slot 26 is formed in the wall of the roller tube 22 which communicates with the dye chamber 24 in the roller tube 12. The slot 26 extends parallel to the axis of the roller tube and terminates short of the ends of the roller tube 22. The disclosed embodiment shows a single slot 26, however, it should be understood that any number of slots 26 can be used limited only by the size of the tube. The roller tube 22 is rotatably mounted on sealed bearings 28 which are journalled around a pipe fitting 30. The outer surface of the roller tube 22 may include a continuous, helical groove 32 to assure proper tracking of the line as it moves across the roller tube 22.

The drive means 18 is provided for rotating the marking roller 12. In the embodiment shown, the drive means 18 comprises a kiss roller 34 which contacts the line wound on the marking roller 12. The kiss roller 34 is mounted on a roller shaft 36 which is driven by a motor (not shown). The surface of the kiss roller 34 is covered with a material having a relatively high coefficient of friction to assure efficient transfer of torque to the marking roller 12 without slipping.

The supply means 20 supplies a disperse dye to the interior 24 of the marking roller 12. The supply means 20 includes a supply tank 56 where a disperse dye is introduced. Conduits 58 and 60 extend from the supply tank 56 through respective pipe fittings 30 and communicate with the dye chamber 24 in the marking roller 12. A heating means 62 heats the dye within the supply tank 56 causing the dye to vaporize. The pressure of the vaporized dye causes the dye to flow through conduits 58 and 60 to the interior of the marking roller 12. The vaporized dye passes through the slot 26 in the marking roller 12 and impregnates the portion of the line which overlies the slot.

For illustrative purposes, the unmarked line is shown initially wound onto a supply spool 40. The supply spool 40, however, is not an essential part of the invention. Instead, the marking roller 12 could be disposed in line with other treatment processes for example, the marking roller 12 could be preceded by a drawing apparatus. The spool 40 is mounted on a winder (not shown) which unwinds the line from the spool 40. A tension device 42 regulates the speed of the winder and insures constant tension on the unmarked line. A guide means, such as a guide wire 44, is provided to insure that the line does not get fouled as it is being wound around the marking roller 12.

The line take-up system 16 includes a take-up spool 48 for taking up the marked line. As with the supply spool 40, the take-up spool is not an essential part of the invention. The marked line winding off the marking roller 12 could be subjected to a subsequent treatment process. The take-up spool 48 is mounted on a winder (not shown), which is regulated by a tension device 50. A guide wire 52 is provided to guide the marked line as it winds off the marking roller 12.

In use, the line is wound off the supply spool 40 or advanced from a previous treatment process onto the marking roller 12. The line is wound around the marking roller a sufficient number of times to completely cover the slot 26. Preferably, the windings of the line should extend beyond both ends of the slot 26. During operation, the line is continuously advanced. The speed of the line and tangential speed of the marking roller 12 are exactly matched so that any given point on the line which overlies the slot 26 will remain in a position over the slot 26 as the line advances from one end of the marking roller 12 to the other. There should not be any slippage between the line and the marking roller, otherwise the marks will not be equally spaced. The helical grooves 32 in the marking roller 12 and the pressure applied by the kiss roller 34 should insure that slippage does not occur.

As the line advances along the marking roller 12, the vaporized dye passes from the dye chamber 24 through the slot 26 and impregnates that portion of the line overlying the slot 26. The width of the slot 26 determines the length of the marks on the line. The circumference of the marking roller 12 determines the distance between the marks.

Because of the heat being applied to vaporize the dye, the entire marking roller 12 will become hot during operation. Accordingly, it may be desirable in certain applications to preheat the line before it is wound onto the marking roller 12. If any preheating is necessary, a preheater 46 can be used to preheat the line before it is wound on the marking roller 12. Similarly, a blower 54 can be used to cool and dry the line as it winds off the marking roller.

Based on the foregoing, it is apparent that the present invention provides a simple, yet efficient method for marking a line at predetermined increments. Because the present invention applies marks to a continuously moving line, the process of the present invention is able to achieve a relatively high throughput. Further, no complicated metering or measuring devices are used which renders the present invention very economical.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A method for marking an advancing line at predetermined increments comprising:
   (a) providing a roller tube having an outer surface with an elongated slot formed therein communicating wit the interior of the roller tube, wherein the elongated slot extends generally axially between a supply end and a take-up end of the roller tube;
   (b) winding the advancing line around the roller tube such that the unmarked line crosses the elongated slot at predetermined increments,
   (c) supplying a disperse dye in a fluid state to the interior of the roller tube; and
   (d) forcing the disperse dye to exit the elongated slot in the roller tube and contact the line overlying the elongated slot to mark the line at predetermined increments as the line is being advanced.

2. The method of marking a line of claim 1 further including the step of rotating the roller tube, wherein the speed of the advancing line is substantially equal to the tangential speed of the roller tube such that any given point of the line overlying the slot will remain in a position over the slot as the line advances from the supply end to the take-up end of the roller tube.

3. The method of marking a line of claim 1 wherein the line is wound around the roller tube in a single layer.

4. The method of marking a line of claim 2 wherein the step of rotating the roller tube includes the step of rotating the roller tube with a kiss roller.

5. The method of marking a line of claim 1 wherein the step of supplying a disperse dye in a fluid state to the interior of the roller tube includes the step of heating and vaporizing a liquid dye.

6. The method of marking a line of claim 1 further including the step of heating the line as it is would onto the roller tube.

7. The method of marking a line of claim 1 further including the step of preheating the line before it is wound onto the roller tube.

8. The method of marking a line of claim 1 further including the method of tensioning the line as it is wound onto and off the roller tube respectively.

9. The method of marking a line of claim 1 further including guiding the advancing line as it is wound onto and off the roller tube respectively.

10. The method of marking a line of claim 1 wherein the roller tube has a plurality of elongated slots, wherein each slot extends axially between the supply end and the take-up end of the roller tube.

11. The method of marking a line of claim 10 wherein the slots are equally spaced around the outer surface of the roller tube.

12. The method of marking a line of claim 1 further including the method of cooling the line as the line winds off the roller tube.

13. An apparatus for marking an advancing line at predetermined increments comprising:
   a) a roller tube having an outer surface and an interior chamber;

b) an elongated slot formed in the outer surface of the roller tube which communicates with the interior chamber of the roller tube and which extends axially between a supply end and a take-up end of the roller tube;

c) a drive for rotating the roller tube to wind the advancing line around the roller tube such that the line crosses the elongated slot at a predetermined increment between the supply end and the take-up end of the roller tube; and d) a dye source for supplying dye in a fluid state to the interior chamber of the roller tube, wherein the dye exits the elongated slot to mark the line at said predetermined increments as the line advances from the supply end to the take-up end of the roller tube.

14. The line marking apparatus of claim 13 further including a continuous, helical groove formed in the outer surface of the roller tube, wherein the line wound on the roller tube is positioned along the helical groove.

15. The line marking apparatus of claim 13 including a plurality of elongated slots, wherein each slot extends axially between the supply end and the take-up end of the roller tube, and wherein the slots are equally spaced around the outer surface of the roller tube.

16. The line marking apparatus of claim 15 further including a supply spool from which the line is supplied to the supply end of the roller tube.

17. The line marking apparatus of claim 16 further including a take-up spool for collecting the line from the take-up end of the roller tube.

18. The line marking apparatus of claim 13 further including first and second tensioning means for tensioning the line as it is wound onto and off the roller tube respectively.

19. The line marking apparatus of claim 13 further including first and second line guide means for guiding the advancing as it is wound onto and off the roller tube respectively.

20. The line marking apparatus of claim 13 further including a preheater for heating the advancing line before it is would onto the roller tube.

21. The line marking apparatus of claim 13 further including cooling means for cooling the line as it winds off the roller tube.

22. The line marking apparatus of claim 13 wherein the drive includes a kiss roller.

* * * * *